United States Patent [19]

Kimblin et al.

[11] 4,250,364

[45] Feb. 10, 1981

[54] VACUUM ARC CURRENT LIMITER WITH OSCILLATING TRANSVERSE MAGNETIC FIELD AND METHOD

[75] Inventors: Clive W. Kimblin, Pittsburgh; Francis A. Holmes, Monroeville Borough; Joachim V. R. Heberlein, Pittsburgh; Joseph G. Gorman, Franklin Township; Westmoreland County; Paul G. Slade, Pittsburgh, all of Pa.

[73] Assignee: Electric Power Research Institute, Inc., Palo Alto, Calif.

[21] Appl. No.: 951,070

[22] Filed: Oct. 13, 1978

[51] Int. Cl.[3] ..... H01H 33/66

[52] U.S. Cl. ..... 200/144 B; 200/147 R

[58] Field of Search ..... 200/144 B, 144 R, 147 R, 200/144 AP, 145, 147; 361/3, 13, 14

[56] References Cited

U.S. PATENT DOCUMENTS

| | | | |
|---|---|---|---|
| 3,147,356 | 9/1964 | Luehring | 200/144 B X |
| 4,021,628 | 5/1977 | Kimblin | 200/144 B |
| 4,027,123 | 5/1977 | Ihara | 200/144 B |
| 4,171,474 | 10/1979 | Holmes | 200/144 B |

*Primary Examiner*—James R. Scott

*Attorney, Agent, or Firm*—Flehr, Hohbach, Test, Albritton & Herbert

[57] ABSTRACT

A vacuum arc current interruption device is installed in a current limiting circuit which includes a parallel resonant circuit. Means are provided for producing transverse lines of magnetic force in the arc gap between the electrodes in the vacuum enclosure. The energizing circuit for the magnetic field coils includes a capacitor bank employing unpolarized capacitors and a switch. After the capacitor bank is charged up, the switch is closed, discharging the capacitors through the field coils and producing lines of magnetic force in the arc gap. The field coils and capacitor bank together form a resonant field circuit having a characteristic resonant frequency which causes periodic reversals in the polarity of the lines of magnetic force. The oscillating magnetic field produces responsive oscillations in the arc voltage of an arc present in the arc gap of the vacuum device, which in turn causes oscillations of the arc current. When oscillations of sufficient magnitude are generated to produce a current zero, the arc is driven to extinction and the circuit current is commuted into a parallel current limiting impedance.

7 Claims, 5 Drawing Figures

VACUUM ARC CURRENT LIMITER WITH OSCILLATING TRANSVERSE MAGNETIC FIELD AND METHOD

BACKGROUND OF THE INVENTION

The invention relates generally to current interruption circuits employing vacuum arc devices for use in controlling fault currents associated with power transmission and distribution lines.

Increased demand for electric power requires utilities to continually enlarge power distribution systems, and to increase the operating voltages of power transmission lines. As the capacity of power systems is enlarged, there is a continuing need in the electric power industry for improved current limiting and interrupting devices.

One type of current interrupting circuit employs a vacuum fault current interrupter which employs separable electrodes in a vacuum enclosure. When the electrodes in such vacuum devices are rapidly separated, arcing occurs in the interelectrode gap. Typically, in prior art vacuum devices of this type, the arc is permitted to burn until a normal current zero in the alternating current cycle, at which point the arc disappears. If sufficient dielectric strength exists in the gap between the contacts, re-ignition is prevented and current interruption is complete.

As the voltages of transmission and distribution lines increase, it becomes increasingly important to interrupt current flow even before the occurrence of a current zero in the alternating current cycle. Fault currents on high voltage lines would otherwise increase so rapidly as to cause significant equipment damage even within the duration of a single current half-cycle. One improved type of vacuum fault current limiting circuit for rapidly extinguishing vacuum arcs is disclosed in U.S. Pat. No. 4,021,628. That patent discloses a current limiter employing a transverse magnetic field of sufficient strength to drive the arc plasma from between the arcing contacts, thus extinguishing the arc. The magnetic field causes an enormous increase in the arc voltage which serves to commute the fault current into a parallel current limiting impedance.

The concept of using a transverse magnetic field, taught in U.S. Pat. No. 4,021,628, offers increased interruption speed and capacity over earlier prior art vacuum interrupters. Nevertheless, commutation failure can occur on such devices when the strength of the transverse field is insufficient to force the arc current to zero. To provide even higher strength magnetic fields in the arc gap of the vacuum device is expensive and presents practical problems in interrupters which must be both highly reliable and rugged. In view of the increasing magnitudes of power carried by power systems, additional suitable techniques are needed to improve the current interrupting effectiveness of such vacuum devices.

OBJECTS AND SUMMARY OF THE INVENTION

It is therefore a general object of the present invention to provide an improved vacuum arc current interruption device which produces rapid arc extinction.

It is another object of the present invention to provide a vacuum arc current interruption device employing magnetic arc suppression which increases the effectiveness of the transverse magnetic field.

Another object of the present invention is to provide an improved method of vacuum arc extinction employing transverse lines of magnetic force in the arc gap.

Accordingly, a vacuum arc current interruption device is provided, comprising an evacuated envelope with a pair of spaced electrodes in the envelope defining an arc gap therebetween. Arcing in the arc gap occurs along an arcing path between the electrodes. A capacitive impedance circuit is connected between the electrodes in parallel with the arc gap. Magnetic means are provided for producing lines of magnetic force in the arc gap transverse to the arcing path. Means connected to the magnetic current means periodically reverse the polarity of the lines of magnetic force.

to extinguish a vacuum arc in the above-described device according to the method of the present invention, lines of magnetic force are produced in the arc gap transverse to the arcing path. The polarity of the lines of magnetic force is periodically changed. The arc voltage of the vacuum arc is modulated in response to the periodically changing lines of magnetic force, causing rapid arc extinction.

DESCRIPTION OF THE PREFERRED EMBODIMENT

Figure 1:
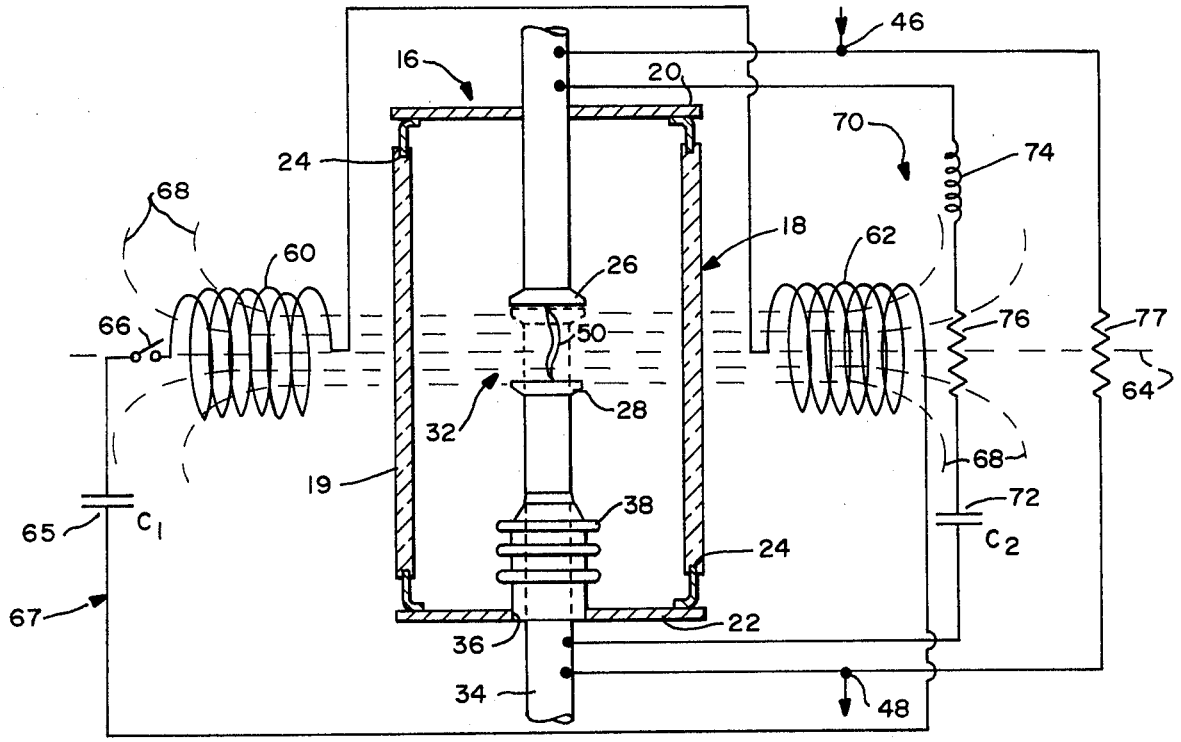
FIG. 1 is a cross-sectional view of a vacuum arc current interruption device according to the present invention.

Referring to FIG. 1, a vacuum arc current interruption device according to the present invention includes a vacuum type current interrupter 16 comprising an evacuated envelope 18 having cylindrical side walls 19 formed of glass or a suitable ceramic material. The envelope is closed by a pair of metal end caps 20 and 22 sealed to cylindrical portion 19 by means of suitable seals 24. Envelope 18 is evacuated sufficiently to insure a mean free electron path longer than the potential breakdown path within the envelope. For this purpose the pressure should be lower than approximately $10^{-4}$ torr.

Within envelope 18 are a pair of spaced electrodes 26 and 28 supported for relative movement. The electrodes are movable between a closed position, shown in phantom in FIG. 1, in which the electrodes are in mutual contact, and an open position as shown with solid lines in FIG. 1. When open, the electrodes define an arc gap 32 therebetween. In the preferred embodiment, relative movement is provided between the electrodes by movable operating rod 34 which extends through an opening 36 in the bottom of envelope 18. A suitable metal bellows 38 provides a seal with operating rod 34 to allow movement without disruption of the vacuum.

External connections to vacuum device 16 include power line connections 46 and 48, which are conductively connected to electrodes 26 and 28, respectively. The power line connections connect to suitable power transmission or distribution lines where the interruption device of the present invention is to be employed. When electrodes 26 and 28 are closed, current passes freely from point 46 to point 48 through device 16. Immediately upon opening of the electrodes, an arc 50 is drawn in arc gap 32 along an arcing path extending between electrodes 26 and 28. Immediately after electrode separation, current flow across arc gap 32 is conducted by arcing between the electrodes.

In a manner similar to the vacuum fault current limiter shown in U.S. Pat. No. 4,021, 628, the interruption device of the present invention includes means for producing transverse lines of magnetic force. In the present invention such means include external field coils 60 and 62 disposed along a transverse axis 64 substantially perpendicular to the arcing path of arc 50. Field coils 60 and 62 are connected to at least one, and preferably a bank of unpolarized capacitors 65 ($C_1$), through switch 66. An unpolarized capacitor means a non-electrolytic type capacitor which can be charged to either polarity. The capacitor 65 serves as a charge storage means for energizing field coils 60 and 62. Capacitor 65 and field coils 60 and 62 together form a resonant field circuit 67 having a first characteristic resonant frequency. When capacitor 65 is discharged by switch 66 through coils 60 and 62, the capacitor supplies current to energize the field coils and, together with the coils, serves as oscillating means for periodically reversing both the current supplied and the resultant lines of magnetic force. The field coils comprise magnetic means for producing lines of magnetic force 68 in arc gap 32 transverse to the arcing path of arc 50. Field circuit 67 is not connected to the power line and operates independent of line potential.

Connected between electrodes 26 and 28 of interrupter 16 in parallel with arc gap 32 is a capacitive impedance circuit 70. Included in capacitive impedance circuit 70 is an unpolarized capacitor 72 ($C_2$). Circuit 70 also includes inductive and resistive impedances 74 and 76, respectively, which may be in the form of residual impedances associated with connecting leads or the like. Inductor 74 and resistor 76 may alternatively be discrete circuit impedance elements as is capacitor 72. Circuit 70 forms a resonant parallel circuit having a second characteristic resonant frequency. Because lead inductances and resistances will always be present in circuits having capacitance, it will be understood that resonant parallel circuit 70 could be formed with only a capacitor. Also in parallel with vacuum interrupter 16, and extending between connections 46 and 48, is a suitable current limiting impedance 77 into which the power line current is diverted upon arc extinction.

Figure 2:
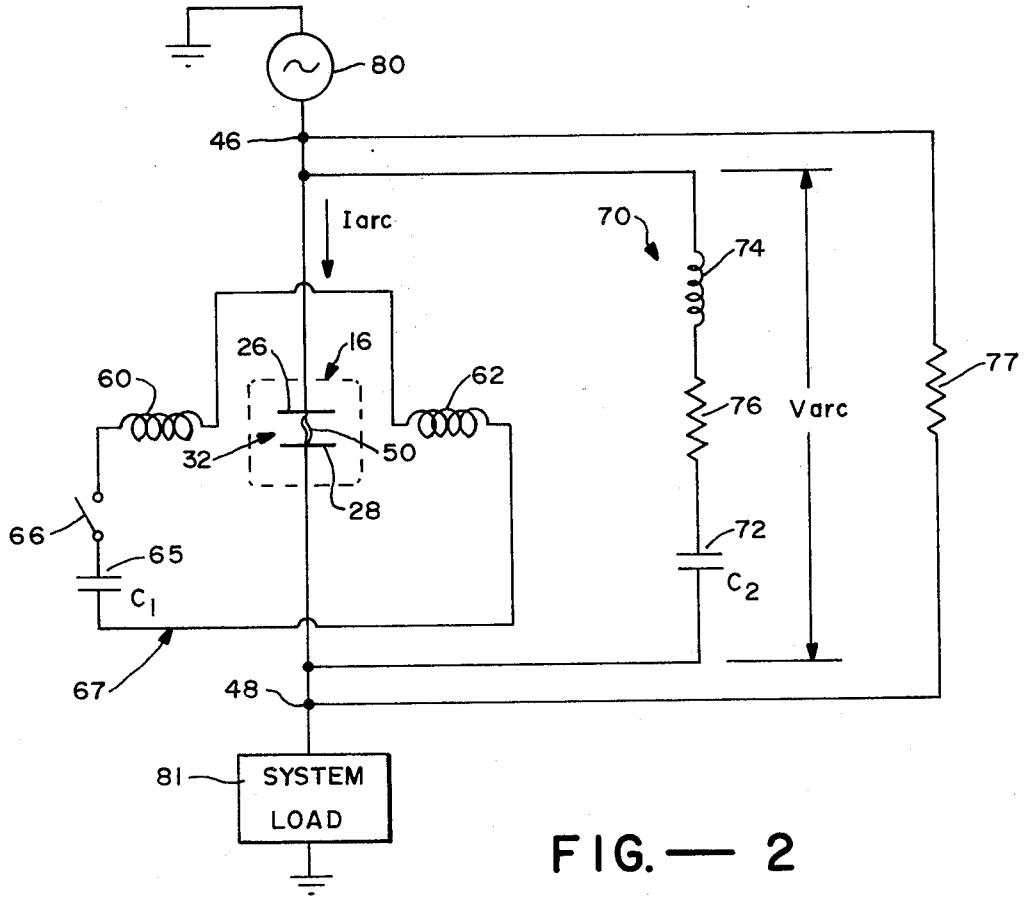
FIG. 2 is a simplified circuit diagram illustrating the circuitry of the device shown in FIG. 1

Operation of the vacuum arc current interruption device of FIG. 1 is illustrated in FIG. 2. The device will typically be used for fault current commutation in a power distribution system. The power system can be an AC system operating at a predetermined signal frequency, as represented by oscillator 80 and load 81. The interrupting device of the present invention is installed on a power transmission or distribution line, between points 46 and 48. With the electrodes closed, current flows freely through the vacuum device 16, preventing any current from passing through resonant parallel circuit 70 or current limiting impedance 77. Apparatus (not shown) continuously monitors the line current through interrupter 16 to detect a fault condition. When a rapid increase in line current indicates a fault, or upon external command, a signal is sent to a suitable actuator (not shown) connected to operating rod 34 of interrupter 16. The actuator will rapidly separate the electrodes. Actuators suitable for use in the present invention should be capable of separating the contacts a distance of approximately two centimeters within one to two milliseconds. Repulsion coils or the like can be used for this purpose. Immediately following electrode separation, an arc 50 appears between electrodes 26 and 28. As is well known in the art, arc 50 will continue to carry substantially the full fault current until extinguished.

Figure 3:
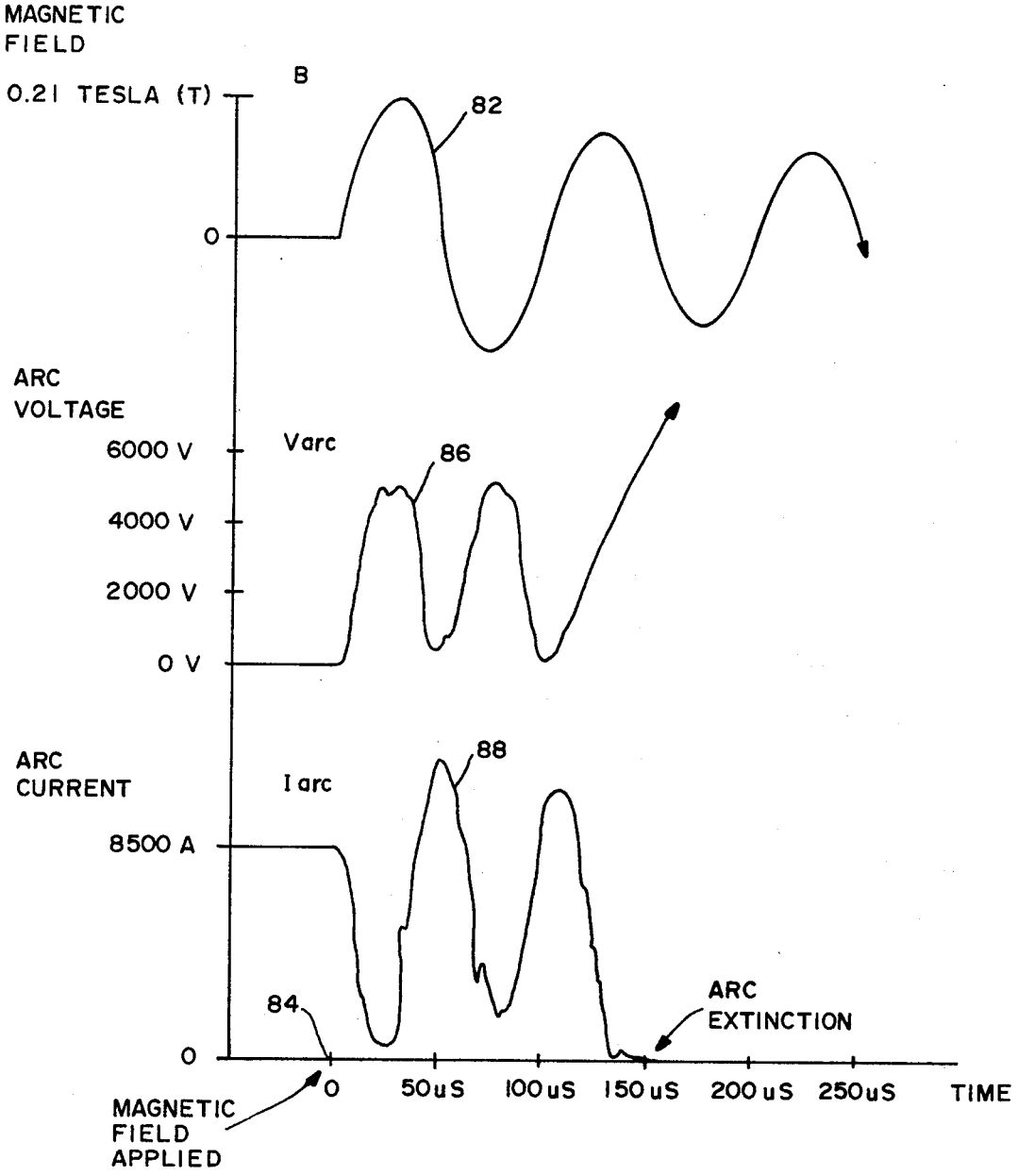
FIG. 3 is a graphic representation showing the waveform of a transverse field applied according to the invention and the effect produced on interelectrode arc voltage and current.

The method of extinguishing the vacuum arc 50, which is present in interrupter 16 immediately following electrode separation, is illustrated in FIGS. 2 and 3. Initially the arc voltage ($V_{arc}$) is low and arc 50 permits a substantially free flow of current through interrupter 16. No substantial amount of current is initially diverted into parallel circuits 70 and 77. It will be understood that prior to the opening of electrodes 26 and 28, capacitor 65 is charged up from an independent supply and maintained in a fully charged state.

When the electrodes are at or near full separation, switch 66 is closed, discharging capacitor 65 through coils 60 and 62 to produce lines of magnetic force transverse to the arcing path of arc 50. Because field circuit 67 forms a resonating circuit, the field produced immediately begins to oscillate, causing periodic changes in the polarity of the lines of magnetic force 68. Referring to FIG. 3, the uppermost trace 82 represents a typical trace for a magnetic field B produced upon closing of switch 66 in an experimental device. Switch closure occurs at point 84, causing a steep rise in magnetic field strength until capacitor 65 is discharged, after which field circuit 67 begins to oscillate. As shown in FIG. 3, the result is a substantially sinusoidal variation in field B, with a periodic reversal of the lines of magnetic force 68 (see FIG. 1). The magnetic field strength shown in trace 82 is damped due to the one-shot nature of the capacitive power source 65.

The two additional traces 86 and 88 of FIG. 3 represent experimentally observed arc voltage and arc current traces for an interrupter 16 subjected to magnetic field B (trace 82). Under the influence of the periodically changing lines of magnetic force, the arc voltage ($V_{arc}$) 86 of arc 50 is modulated at a rate roughly proportional to the absolute value of magnetic field B. Prior to the closing of switch 66, at 84, the arc voltage is substantially zero and the arc carries the full fault current. As soon as the magnetic field begins to rise, the arc voltage increases substantially. Oscillations in the magnetic field cause responsive oscillations in $V_{arc}$ which, in turn, causes resonant parallel circuit 70 to oscillate at its characteristic resonant frequency. Whenever the arc voltage becomes sufficiently large, arc current 88 ($I_{arc}$) is diverted into resonant parallel circuit 70. There is a resultant variation in $I_{arc}$, as shown in FIG. 3. Initially, before the magnetic field is applied, $I_{arc}$ is high. After the closure of switch 66 at 84, $I_{arc}$ begins to oscillate until driven to zero, at which time the interelectrode voltage $V_{arc}$ is determined solely by the parallel circuit. As shown in FIG. 3, $V_{arc}$ and $I_{arc}$ oscillate at approximately twice the frequency of magnetic field B. The magnitude of the oscillations in $I_{arc}$ and $V_{arc}$ shown in FIG. 3 represent typical average values, and minor fluctuations around the values shown will commonly occur due to high noise levels in the arcing environment. The arc current might be driven to zero several times before permanent arc extinction occurs. The arc current and voltage might even be driven to negative values as they oscillate. Once the arc has been extinguished and $I_{arc}$ equals zero, the power line current is diverted through parallel impedance 77 which limits the current to a safe level.

As shown by the horizontal scale in FIG. 3, arc extinction occurs in less than two hundred microseconds of application of the transverse magnetic field. Because the typical fixed signal frequency of a power distribution system (oscillator 80) is comparatively low (for example, 60 Hz), arc extinction occurs within a small fraction of a single half-cycle. As such, the current through the device at the time of contact opening can be considered essentially DC.

Rapid arcs extinction by the method of the present invention depends upon introducing rapid oscillations in the arc voltage by means of an oscillating transverse magnetic field. For this purpose, the first characteristic resonant frequency of resonant field circuit 67 should be substantially higher than the signal frequency of the alternating current of power system 80.

Figure 4:
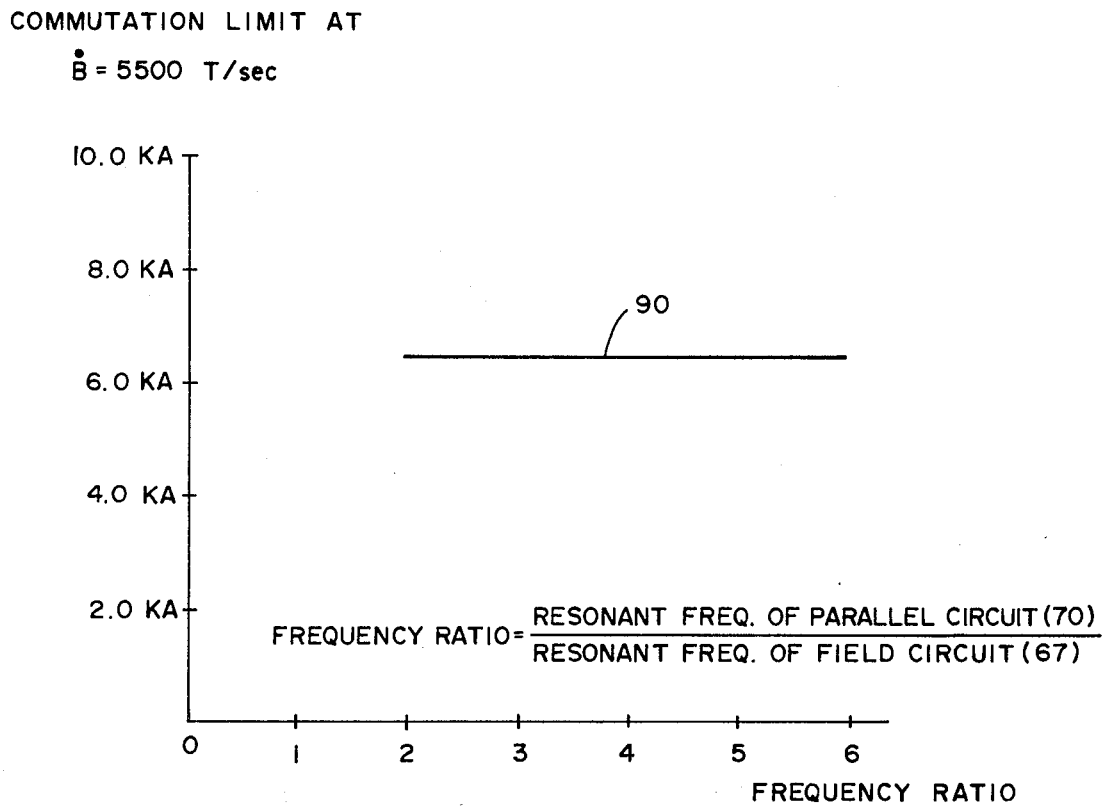
FIG. 4 is a graphic representation of frequency ratios between the characteristic resonant frequencies of the resonant field circuit and the resonant parallel circuit of the device shown in FIG. 1.

The precise relationship between the characteristic resonant frequencies of field circuit 67 and parallel circuit 70 is not critical, although it is preferable for parallel circuit 70 to have a resonant frequency at least as great as twice the resonant frequency of field circuit 67. FIG. 4 illustrates that there is no significant change in interruption performance with changes in the ratio of characteristic resonant frequencies between parallel circuit 70 and field circuit 67. Specifically, trace 90 shows that there is no change in the maximum commutating limit (given $\dot{B}=5500$ T/sec) when the ratio of the second characteristic resonant frequency of parallel circuit 70 to the first characteristic resonant frequency of field circuit 67 is increased beyond two. It has been found, however, that reducing the frequency ratio below two results in some loss of interruption performance.

The present invention provides for improved current interruption ability over interrupters which do not employ transverse magnetic fields for arc extinction. The invention can interrupt larger currents than interrupters employing non-oscillating transverse fields such as those disclosed in U.S. Pat. No. 4,021,628. It has been found that the modulations introduced in the arc current by a varying magnetic field tend to drive the arc current to zero more rapidly than if a non-oscillating magnetic field of the same average strength is used. Rapid arc extinction is particularly desirable in interrupters of this type because the transverse magnetic field is energized from a capacitive source which has a very short peak current output. In prior art interrupters, the field coils are customarily energized by a polarized electrolytic capacitor, and oscillations are prevented by a diode or similar unidirectional circuit device. Field strength initially rises rapidly and then slowly decays, and only a single magnetic field peak occurs. If arc extinction is not successful at or shortly after the magnetic field has peaked, the likelihood of successful current interruption is greatly reduced. In the present invention the field circuit is permitted to oscillate at its characteristic resonant frequency. The oscillating magnetic field sets up corresponding oscillations in the arc current and voltage which produce sucessful current interruptions at higher current levels than with a non-oscillating magnetic field of equal magnitude.

Figure 5:
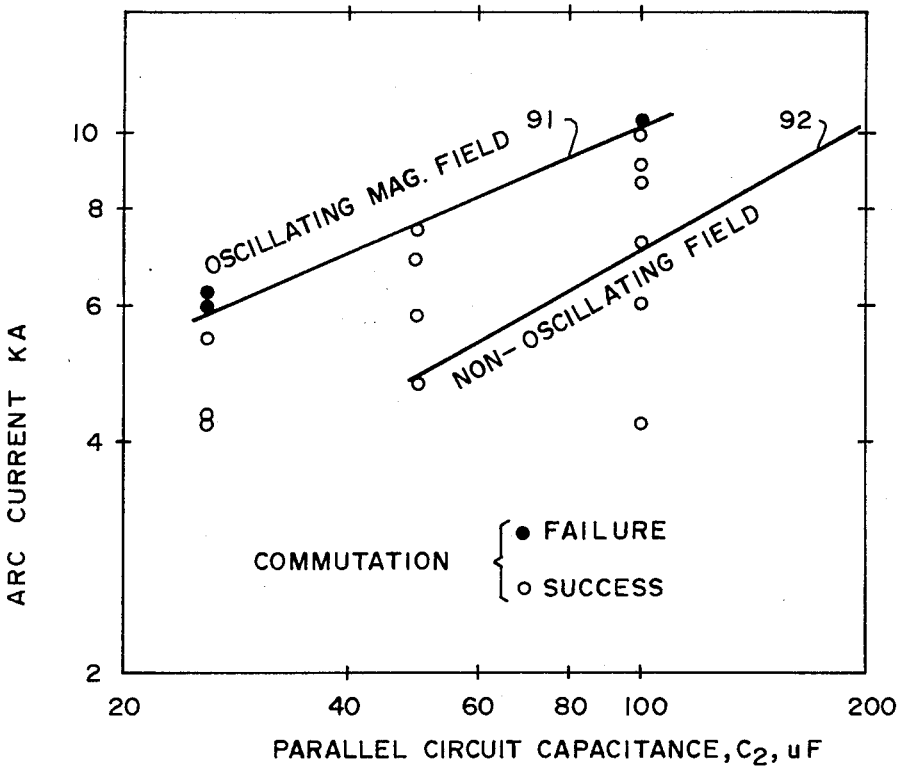
FIG. 5 is a graphic representation of the performance of an interrupter having an oscillating transverse magnetic field with respect to external parallel circuit capacitance.

FIG. 5 compares the performance of interrupters according to the present invention with interrupters employing essentially the same circuit but with a non-oscillating magnetic field. At any given value of external capacitance, which refers to $C_2$ in FIGS. 1 and 2, the magnitude of the arc current successfully commutated into a parallel impedance is higher. In FIG. 5 trace 91 represents the arc current successfully commutated in an interrupter employing an oscillating magnetic field, and trace 92 represents successful commutations in the same interrupter, but with a non-oscillating magnetic field. As is evident, commutation increases of 60% are typical with the present invention.

The present invention increases the commutating ability of vacuum-type current interrupters employing transverse magnetic fields. By oscillating the magnetic field, larger currents can be controlled without a proportional increase in average field strength. The invention improves the likelihood of successful fault current control at any given current level. Improved performance is achieved at relatively low additional cost over vacuum interrupters employing non-oscillating transverse magnetic fields. The invention can be used in both AC and DC circuits and is insensitive to the polarity of the arc current. Although the preferred embodiment shows an interrupter having separable electrodes, the present invention can also be employed with vacuum arc devices having fixed, immovable electrodes defining the arc gap.

The present invention provides an improved vacuum arc current interruption device which produces rapid arc extinction. The invention provides a vacuum arc current interruption device which increases the effectiveness of the transverse magnetic field. The invention further provides an improved method of vacuum arc extinction employing transverse lines of magnetic force in the arc gap.

What is claimed is:

1. A vacuum arc current interruption device comprising: an evacuated envelope, a pair of electrodes supported in said envelope for relative movement between a closed position in which said electrodes are in mutual contact and an open position in which said electrodes are separated to define an arc gap there-between, arcing in said arc gap occurring along an arcing path between said electrodes as said electrodes are moved from a closed position to an open position when said electrodes are separated, magnetic means for producing an oscillatory magnetic field in said arc gap transverse to said arcing path and for producing an oscillatory arc voltage, and resonant circuit means connected between said electrodes in parallel with said arc gap and responsive to said oscillatory arc voltage to produce an oscillatory arc current whereby said arc tends to be extinguished when said current approaches zero.

2. A device as in claim 1 in which said magnetic means includes capacitive charge storage means for energizing said field coils.

3. A device as in claim 2 in which said capacitive charge storage means includes at least one unpolarized capacitor, and swtich means for discharging said unpolarized capacitor through said field coils, said unpolarized capacitor and said field coils forming a resonant field circuit having a first characteristic resonant frequency.

4. A device as in claim 3 in which said resonant circuit means includes inductance and capacitance and forms a resonant parallel circuit having a second characteristic resonant frequency.

5. A device as in claim 4 in which said second characteristic resonant frequency of said resonant parallel circuit is at least as great as twice said first characteristic resonant frequency of said resonant field circuit.

6. A device as in claim 1 in which said device is employed to rapidly interrupt an alternating current having a predetermined signal frequency, said first characteristic resonant frequency of said resonant field circuit being substantially higher than said signal frequency.

7. A method of vacuum arc extinction in a circuit in which the vacuum arc extends along an arcing path in an arc gap between a pair of spaced electrodes disposed in an evacuated envelope, and in which a resonant field circuit having a first characteristic resonant frequency is associated with said circuit for producing lines of magnetic force, and including a resonant parallel circuit having capacitance and inductance connected between said electrodes in parallel with said arc gap and having a second characteristic resonant frequency, said method comprising the steps of: causing said resonant field circuit to produce lines of magnetic force in said arc gap transverse to said arcing path and permitting said resonant field circuit to oscillate at said first characteristic resonant frequency whereby said lines of magnetic force are periodically reversed along with any arc voltage in said arc gap, and in response to said periodically reversing arc voltage simultaneously causing arc current carried by said resonant parallel circuit to oscillate at said second characteristic resonant frequency whereby said arc tends to be extinguished when said current approaches zero.

* * * * *